US010399846B2

(12) United States Patent
Vellutato, Jr. et al.

(10) Patent No.: US 10,399,846 B2
(45) **Date of Patent: *Sep. 3, 2019**

(54) APPARATUS AND METHOD FOR MIXING AND DISPENSING

(71) Applicants: Veltek Associates, Inc., Malvern, PA (US); Arthur L. Vellutato, Jr., Malvern, PA (US)

(72) Inventors: Arthur L. Vellutato, Jr., Malvern, PA (US); Arthur L. Vellutato, Sr., Exton, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/728,555

(22) Filed: Oct. 10, 2017

(65) Prior Publication Data

US 2018/0029875 A1 Feb. 1, 2018

Related U.S. Application Data

(60) Continuation of application No. 14/813,663, filed on Jul. 30, 2015, now Pat. No. 9,809,442, which is a (Continued)

(51) Int. Cl.
*B67D 7/74* (2010.01)
*B01F 15/02* (2006.01)

(Continued)

(52) U.S. Cl.
CPC ..... *B67D 7/741* (2013.01); *B01F 3/0865* (2013.01); *B01F 5/10* (2013.01); *B01F 5/106* (2013.01);

(Continued)

(58) Field of Classification Search
CPC ..... B67D 7/741; B67D 7/02; B67D 7/423; B67D 7/58; B67D 7/62; B67D 7/78;

(Continued)

(56) References Cited

U.S. PATENT DOCUMENTS 2,738,429 A 3/1956 Goldblith
2,904,392 A 9/1959 Pomerantz (Continued)

FOREIGN PATENT DOCUMENTS

CN 1649772 A 8/2005
CN 201058029 Y 5/2008

(Continued)

OTHER PUBLICATIONS

English-language translation of Office Action for Chinese Patent Application No. 201510488936.8, dated Jul. 23, 2018, 16 pages.

(Continued)

*Primary Examiner* — Patrick M. Buechner

(57) ABSTRACT

A mixing and dispensing apparatus, including a first container (for containing a first substance), a second container (for containing a second substance), and a tube system (that combines the first and second substances into one combined substance and mixes and dispenses the combined substance). Notably, a fluid-impermeable enclosure encloses the first container, the second container, and the tube system. Therefore, instead of performing the time-consuming process of formulating alcohol (used to decontaminate surfaces in clean room environments) to desired levels and filter-sterilizing it in the clean room environment, the claimed apparatus can be pre-filled off-site, sterilized, shipped to the destination, remain sterilized during shipment, and be used to combine (and mix and dispense) the substances on site.

20 Claims, 4 Drawing Sheets

Related U.S. Application Data continuation of application No. 14/552,076, filed on Nov. 24, 2014, now abandoned, which is a division of application No. 12/271,383, filed on Nov. 14, 2008, now abandoned.

(51) Int. Cl.

| | |
|---|---|
| ***B01F 5/10*** | (2006.01) |
| ***B67D 7/58*** | (2010.01) |
| ***B67D 7/78*** | (2010.01) |
| ***B67D 7/02*** | (2010.01) |
| ***B67D 7/42*** | (2010.01) |
| ***B67D 7/62*** | (2010.01) |
| ***B01F 3/08*** | (2006.01) |
| ***B65D 83/38*** | (2006.01) |

(52) U.S. Cl.

CPC ..... *B01F 15/0245* (2013.01); *B65D 83/38* (2013.01); *B67D 7/02* (2013.01); *B67D 7/423* (2013.01); *B67D 7/58* (2013.01); *B67D 7/62* (2013.01); *B67D 7/78* (2013.01)

(58) Field of Classification Search

CPC ..... B65D 83/38; B01F 3/0865; B01F 5/10; B01F 5/106; B01F 15/0245; B01F 15/0243; B01F 15/0283; B01F 15/0266; B01F 15/00961; B01F 15/00993; A61L 2202/18; A61L 2202/182

See application file for complete search history.

(56) References Cited

U.S. PATENT DOCUMENTS

| | | | | |
|---|---|---|---|---|
| 2,961,140 | A | 11/1960 | Holmes | |
| 3,476,506 | A | 11/1969 | Andersen et al. | |
| 3,669,299 | A | 6/1972 | Jones et al. | |
| 3,670,874 | A | 6/1972 | Brunner et al. | |
| 3,726,439 | A | 4/1973 | Sjostrand | |
| 3,763,990 | A | 10/1973 | Ouska | |
| 4,042,004 | A | 8/1977 | Kwan | |
| 4,045,004 | A | 8/1977 | Berger | |
| 4,700,838 | A | 10/1987 | Falciani et al. | |
| 4,714,595 | A | 12/1987 | Anthony et al. | |
| 4,734,198 | A | 3/1988 | Harm et al. | |
| 4,896,768 | A | 1/1990 | Anderson | |
| 4,927,010 | A | 5/1990 | Kannankeril | |
| 4,968,624 | A | 11/1990 | Bacehowski et al. | |
| 5,000,351 | A | 3/1991 | Rudick | |
| 5,060,823 | A | 10/1991 | Perlman | |
| 5,069,370 | A | 12/1991 | Cady et al. | |
| 5,118,197 | A * | 6/1992 | Ellenberger | B01F 3/088 366/16 |
| 5,119,668 | A | 6/1992 | Lehnert et al. | |
| 5,465,874 | A | 11/1995 | Roach et al. | |
| 5,518,146 | A | 5/1996 | Mattei | |
| 5,609,417 | A | 3/1997 | Otte | |
| 6,045,013 | A | 4/2000 | Yang | |
| 6,099,160 | A * | 8/2000 | Flackett | B01F 11/0008 366/217 |
| 6,158,673 | A | 12/2000 | Toetschinger et al. | |
| 6,283,294 | B1 * | 9/2001 | Thorball | A23L 2/52 206/438 |
| 6,290,385 | B1 | 9/2001 | Johansson | |
| 6,333,006 | B1 | 12/2001 | Vellutato | |
| 6,817,485 | B2 | 11/2004 | Kawai et al. | |
| 6,851,580 | B2 | 2/2005 | Stank et al. | |
| 7,042,695 | B2 | 5/2006 | Przytulla et al. | |
| 7,066,354 | B2 | 6/2006 | Stank et al. | |
| 7,137,531 | B2 | 11/2006 | Arghyris et al. | |
| 7,434,687 | B2 * | 10/2008 | Itou | A61M 25/002 206/363 |
| 9,809,442 | B2 * | 11/2017 | Vellutato, Jr. | B67D 7/02 |
| 2002/0154567 | A1 | 10/2002 | Husher | |
| 2004/0063600 | A1 | 4/2004 | Williams et al. | |
| 2004/0065682 | A1 | 4/2004 | Floyd et al. | |
| 2004/0151062 | A1 | 8/2004 | Yao et al. | |
| 2004/0256329 | A1 * | 12/2004 | Meserol | A61L 2/0011 210/748.09 |
| 2005/0163651 | A1 | 7/2005 | Vellutato | |
| 2007/0064519 | A1 | 3/2007 | Neumann | |
| 2009/0194453 | A1 * | 8/2009 | Thorne, Jr. | A61J 1/2096 206/571 |
| 2010/0122992 | A1 | 5/2010 | Vellutato, Sr. et al. | |
| 2011/0017776 | A1 | 1/2011 | Metropulos et al. | |
| 2014/0197196 | A1 | 7/2014 | Tederous et al. | |
| 2015/0336139 | A1 * | 11/2015 | Deprey | B08B 9/032 134/22.12 |
| 2016/0297152 | A1 * | 10/2016 | Maggiore | B33Y 10/00 |
| 2017/0172397 | A1 * | 6/2017 | Zardini | A61B 1/00142 |
| 2017/0349305 | A1 * | 12/2017 | Tomes | A61M 25/00 |
| 2018/0057196 | A1 * | 3/2018 | Tomes | A61M 25/00 |
| 2018/0221564 | A1 * | 8/2018 | Patel | B65B 55/08 |

FOREIGN PATENT DOCUMENTS

| | | | |
|---|---|---|---|
| DE | 69928937 | T2 | 7/2006 |
| EP | 1090847 | A1 | 4/2001 |
| EP | 1496011 | A1 | 1/2005 |
| JP | 53027882 | A | 3/1978 |
| JP | 61127490 | A | 6/1986 |
| JP | 63057299 | A | 3/1988 |
| TW | 412419 | B | 11/2000 |
| WO | WO-2006134616 | A1 | 12/2006 |

OTHER PUBLICATIONS

Singapore Search Report & Written Opinion for SG Application No. 10201506248P, dated Nov. 21, 2017, 6 pages.

European Patent Office; EP Search Report for EP Application No. 09826742.0, dated Sep. 9, 2012.

* cited by examiner

APPARATUS AND METHOD FOR MIXING AND DISPENSING

The present application is a continuation of U.S. patent application Ser. No. 14/813,663, filed on Jul. 30, 2015, which is a continuation of Ser. No. 14/552,076, filed on Nov. 24, 2014, which is a divisional of U.S. patent application Ser. No. 12/271,383, filed on Nov. 14, 2008. The entire disclosure of the aforementioned applications are hereby incorporated by reference in their entirety as if fully set forth herein.

FIELD OF THE INVENTION

The present invention relates to a method and apparatus for mixing two substances and dispensing the mixed substances. More particularly, the present invention relates to a mixing and dispensing system utilizing a pumping system for mixing two substances and dispensing the mixed substances to a desired location.

BACKGROUND OF THE INVENTION

A number of containers have been developed to separately store two substances and allow the two substances to be mixed together prior to being dispensed. One technique for mixing the substances is shown, for instance, in U.S. Pat. No. 7,137,531 to Arghyris et al. This patent discloses a system having two sealed flexible bags containing two kinds of fluids and a pump for mixing the fluids. The pump dispenses the fluids separately or mixed. Among other things, these containers, however, are not suitable for mixing and dispensing substances of a large volume such as 200 liters.

In addition, alcohol have been used in clean room environments for many years to decontaminate various devices, instruments, gloves, incoming components, critical product contact surfaces, critical non-product contact surfaces, and surfaces that are used inside the clean room. Alcohol (which is not naturally sterile) was being sterilized by the end user on-site in volumes that were limited due to the flammable nature of the alcohol. This required that the alcohol be sterile filtered in a Class 100 environment (clean room or clean hood) into a pre-sterilized container, which is generally known as "aseptic" processing, and stored in clean and sterile environments. The end user would formulate the alcohol to the desired levels, filter-sterilize it in the area into pre-sterilized containers, and draw it off on an as-needed basis. In addition, the sterilized alcohol could become contaminated after use, so that clean rooms generally were not able to keep a supply of sterilized alcohol for long periods of time. The sterilization of alcohol was a time-consuming process that detracted from the other work being performed in the clean room.

Chemical compositions such as phenols, cleaners, quaternary ammoniums, hydrogen peroxide, bleach, peracetic acid and hydrogen peroxide have also been used in clean room environments. Typically, concentrates of these chemical components are mixed with water on-site and on-demand to provide diluted disinfectants. However, this manual mixing process is labor intensive and cumbersome.

SUMMARY OF THE INVENTION

It is therefore an object of the invention to provide a mixing and dispensing system suitable for large volumes. It is a further object of the invention to provide a mixing and dispensing system that provides a closed system that is terminally sterilized for use by an end user in a clean room. It is a further object of the invention to provide a system that is pre-assembled for use by the end user. It is yet another object of the invention to provide a dispensing system that provides a desired substance within a clean room and does not detract from the other work being performed in the clean room.

In the present invention, a method for mixing and dispensing two substances is provided. The method includes the steps of: providing a first container containing a first substance; providing a second container containing a second substance; providing a pump system; connecting the pumping system to the first and second containers; operating the pump system to combine the first substance with the second substance by pumping the first substance from the first container into the second container; operating the pump system to circulate the combined substance to generate a mixed substance; and operating the pump system to dispense the mixed substance.

The present invention also provides an apparatus for mixing and dispensing two substances, which includes: a first substance a first container for containing a first substance, a second container for containing a second substance, a feeding tube, and a pumping system connected to the first container, the second container, and the feeding tube; wherein the system comprises at least three modes of operation: combining the first and second substances into one combined substance, mixing the combined substance, and dispensing the mixed substance; and wherein the pumping system is adapted to perform the at least three modes of operation and dispense the mixed substance to the feeding tube.

The present invention also includes a device and method for sterilizing, including the steps of: providing a first container with a first substance; providing a second container with a second substance; connecting the first container to the second container with at least one tube; enclosing the first and second containers and the at least one tube in at least one bag; closing the at least one bag to form a container enclosure; and sterilizing the container enclosure.

DETAILED DESCRIPTION OF THE PREFERRED EMBODIMENTS

Figure 1:
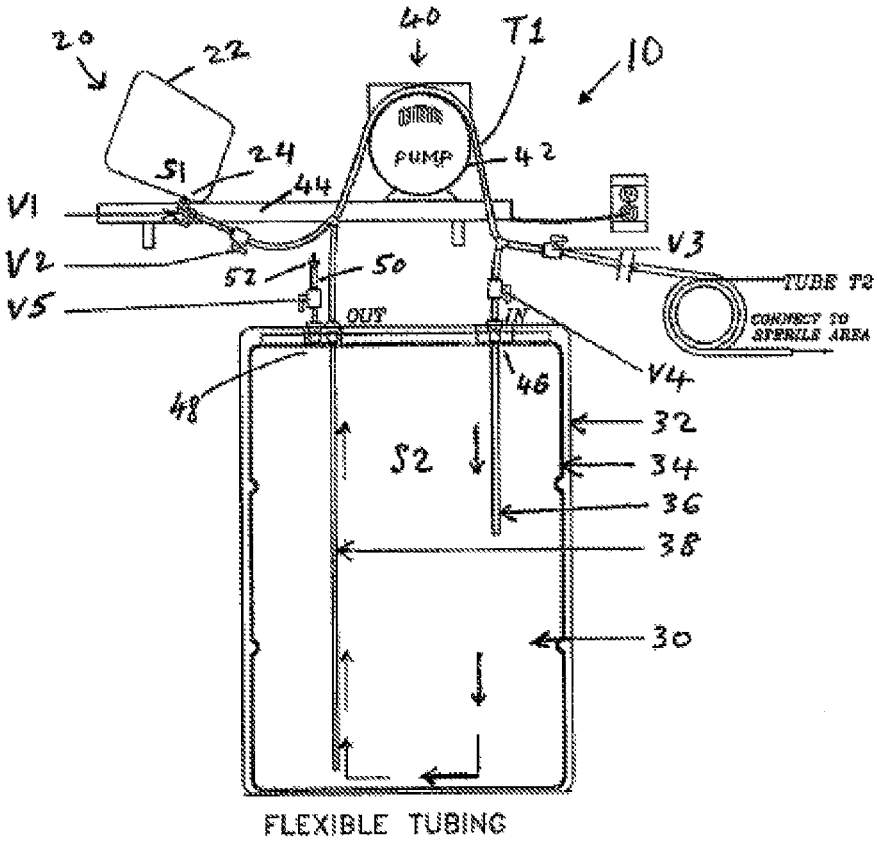
FIG. 1 is a mixing and dispensing apparatus with flexible pipes according to an exemplary embodiment of the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents that operate in similar manner to accomplish a similar purpose.

Turning to the drawings, FIG. 1 shows a mixing and dispensing apparatus 10 in accordance with an exemplary embodiment of the present invention. The apparatus 10 includes, among other elements, a first small container 20, a second large container 30, a pumping system 40, and a feeding tube T2. The first container 20 contains a first substance S1 and the second container 30, larger than the first container 20, contains a second substance S2. The pumping system 40 is connected to the first container 20, the second container 30, and the feeding tube T2. As will be described in more detail below, the pumping system 40 has the function of combining the first and second substances by pumping the first substance from the first container 20 into the second container 30, circulating and mixing the combined substance, and dispensing the combined substance to a desired location via the feeding tube T2.

The first container 20 includes a body 22 and a neck or nozzle 24. The first container 20 may be made of a durable material, such as high-density polyethylene (HDPE), to contain and protect the first substance therein. The first substance S1 can be concentrate sanitizers, disinfectants and sporicide which, when mixed with water, do not remain stable for extended time periods such as beyond 30 days. For example the first substance S1 can be phenols, cleaners, quaternary ammoniums, hydrogen peroxide, bleach, peracetic acid or hydrogen peroxide.

The second container 30 includes an outer layer 32 and an inner drum 34. The inner drum 34 forms a lining inside the outer layer 32, with a thin space of insulation therebetween. The outer layer 32 may be made of any durable material such as plastic or metal. The inner drum 34 is also made of a durable material to protect the substance therein. The top of the second container 30 includes an input neck 46 and an output neck 48, each of which is sealed by a device, such as a cork. Inside the inner drum 34, an input pipe 36 is attached to the sealing device at the input neck 46 for receiving substances in the second container 30. As shown in FIG. 1, the input pipe 36 is approximately half the height of the second container 30 to lead the received substances to the middle section of the second container 30. The inner drum 34 also has an output pipe 38 attached to the output neck 48. When the substance inside the second container 30 is drawn or pumped out of the container, the substance goes through the output pipe 38. Accordingly, as shown in FIG. 1, the output pipe 38 preferably extends almost to the bottom of the second container 30 such that substantially all of the substance inside the second container 30 can be pumped out. The input pipe 36 and output pipe 38 may be flexible or hard. They can also be made of rubber, plastic, metal or any material suitable for the substances contained in the second container 30.

The second container 30 also includes an exhaust pipe 50 attached to the output neck 48. A valve V5 is connected to the exhaust pipe 50 to open and close the exhaust. When the valve V5 is open, air is drawn into the second container 30 to allow the substance inside the container 30 to be easily pumped out through the output pipe 38. When the second container 30 receives a substance through the input pipe 36, the valve V5 may be closed. The top of the exhaust pipe 50 is attached to an exhaust cap 52 having a filter in order to prevent dirt from getting inside the second container 30.

The second container 30 is preferably larger than the first container 20. However, the first and second containers 20 and 30 can be made of any sizes to accommodate the substances contained therein. In FIG. 1, the first container 20 may be a small container for levels of concentrate from 1 oz to 128 oz, or a slightly bigger container for larger volumes of concentrate up to 375 oz. The second container 30 is a 200-liter or 55-gallon container. When the first and second containers 20, 30 are filled, the system 10 weighs about 600 to 700 lbs. Furthermore, the first and second containers 20, 30 may have any shapes. For example, the second container 30 can be rectangular or cylindrical.

The pumping system 40 includes a pump 42, a main tube T1, and four valves V1-V4 for regulating the flow of fluid that goes through the main tube T1 and the pump 42. The first valve V1 is attached to the first container 20 and one end of the main tube T1 for releasing the first substance S1 in the first container 20 into the main tube T1. The first valve V1 may be built into the first container 20 such that the first valve V1 comes with the first container 20 whenever the first container 20 is replaced. The second valve V2 is connected between the first valve V1 and the pump 42 for allowing the first substance S1 to flow from the first container 20 to the pump 42 and into the second container 30. Once this is done, the first valve V1 is closed so that the liquid in the second container 30 does not re-enter the first container 20 during the recirculation and mixing phase of the solutions.

The third valve V3 is connected to another end of the main tube T1 and the feeding tube T2 for controlling the dispensing of the mixed substance from the pump 42 to the feeding tube T2 and to the desired location. Accordingly, V3 is open only when the system 10 is ready to dispense the mixed substance. The fourth valve V4 is connected between the pump 42 and the input neck 46 of the second container 30 for controlling the fluid that comes into the second container 30.

The pump 42 functions as a central driving force for combining the first and second substances by draining the first substance from the first container 20 into the second container 30. The pump 42 is also for mixing the first and second substances by circulating the mixture of the substances in a loop, in which the mixed substances from inside the container 30 flow through the output pipe 38 to the main tube T1, through the pump 42, and back into the second container 30 via the input pipe 36. Finally, the pump 42 is for dispensing the mixed substances from inside the second container 30 to the feeding tube T2 and to a desired location.

The pump 42 is mounted to or sits on a station 44 for stability. In the embodiment of FIG. 1, the pump 42 has an on and off switch (not shown) and a power cord plugged into a power outlet. The pump 42 may also have a filter for filtering the fluid that goes through it. Preferably, the pump 42 is a peristaltic pump.

Figure 2:
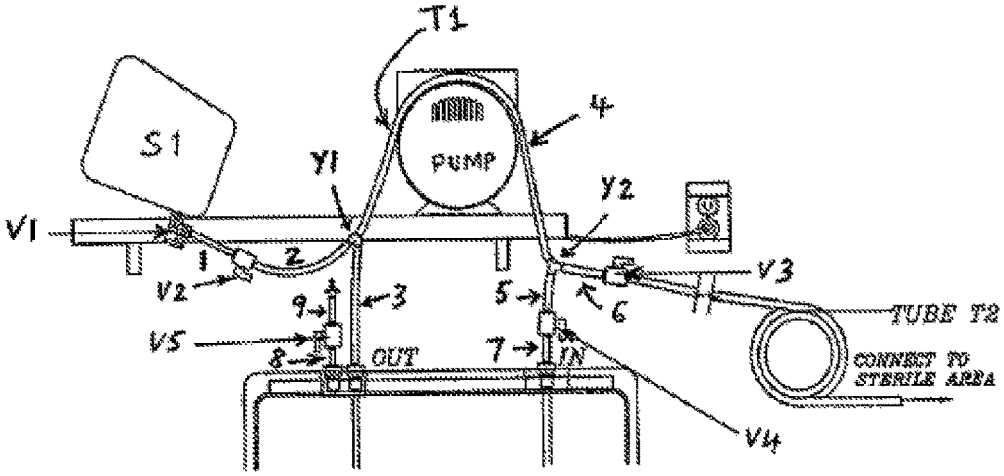
FIG. 2 is a more detailed illustration of a portion of FIG. 1.

FIG. 2 is a more detailed drawing of the main tube T1 and the feeding tube T2 of the FIG. 1. As shown in FIG. 2, the main tube T1 includes first through seventh tube sections, 1-7, respectively. As shown, the first tube section 1 connects the first valve V1 to the second valve V2, the second tube section 2 connects the second valve V2 and the first Y-connector Y1, the third tube section 3 connects the output neck 48 to the first Y-connection Y1. The fourth or middle tube section 4 connects the first connector Y1 to a second Y-connector Y2 through the pump 42. The fifth tube section 5 connects the second connector Y2 to the fourth valve V4. The sixth tube section 6 connects the second connector Y2 to the third valve V3, and the seventh tube section 7 connects the valve V4 to the input neck 46 of the second container 30.

Thus, the main tube T1 connects all elements in the mixing and dispensing apparatus 10 together. Generally, the middle tube section 4 of the main tube T1 is positioned in a pump slot (not shown) of the pump 42. Thus, the tube section 4 need not be cut or opened to be connected with the pump 42. The tube section 4 connects to the first and second Y-connectors Y1 and Y2, which split the main tube T1 into four ends, 2, 3, 5 and 6. The first end 1, 2 is connected to the first valve V1 to be in fluid connection with the first container 20. The second end 3 is connected to the output neck 48 to be in fluid connection with the second container 30. The third end 4 is connected to the third valve V3 to be in fluid connection with the feeding tube T2, and the fourth end 5, 7 is connected to the input neck 46 to be in fluid communication with the second container 30.

The Y-connectors are preferably open to permit bidirectional flow. However, in an alternative embodiment, the connectors Y1 and Y2 can be one-way connectors, which allow fluid to flow therethrough in one direction and not the other. For example, in FIG. 2, the one-way connector Y1 could allow the fluid to flow from the first container 20 to the pump 42, but not allow that fluid to go down the third tube section 3 into the second container 30. Similar, fluid could flow from the output neck 48 through the connector Y1 to the pump 42, but the same fluid could not flow down the second tube section 2 to the first container 20. With the second connector Y2 being a one-way connector, fluid may flow from the pump 42 to the feeding tube T2 and the input neck 46, but not flow from the input neck 46 or from the feeding tube T2 to the pump 42.

The feeding tube T2 has one end, sixth tube section 6, connected to the valve V3 and the other end extendable to dispense the mixed substance to a desired location. The other end of the tube T2 may also have a valve to control the dispensing of the mixed substance. In FIG. 1, the feeding tube T2 is shown to be a rolled-up pipe denoting that it can be extended to any distant location. If the desired location is located in a room separate from the room that contains the pump system 40, the feeding tube T2 can be put through a hole in a wall or plugged into a fitting of a pipe that leads to the desired location. The tube T2 can be made of a flexible or rigid material. It may also have a plastic sheath around its outer layer for protection.

FIG. 2 also shows the detail of the exhaust pipe 50 connected to the output neck 48 of the second container 30. The exhaust pipe 50 includes an eighth tube section 8 connected between the output neck 48 and the valve V5 and a ninth tube section 9 connected between the valve V5 and the exhaust cap 52. As explained below, during the mixing and dispensing modes, the valve V5 is opened to allow air to come into the second container 30 for enabling the mixed substances to be easily dispensed out of the second container 30.

The tube sections 1-9 shown in FIG. 2 can have any desired lengths and colors. For instance, in one embodiment, the tube sections 1, 3-5, and 7 can be tan or opaque while the tube sections 2, 6, 8, and 9 are clear or transparent. The tube section 1 can be 4 inches. The tube sections 2 and 3 can be 24 inches. The tube section 4 can be 48 inches. The tube sections 5-8 can be 6 inches, and the tube section 9 can be 3 inches. The feeding tube T2 can be 20 feet and clear or transparent.

The mixing and dispensing apparatus 10 of the present invention can be used for any suitable environment or purposes where two substances need to be mixed prior to being dispensed. As an example, the apparatus 10 is used in a clean room environment for mixing and dispensing approximately 200 liters of disinfecting solution. In that instance, the first container 20 contains a concentrated active disinfectant filtered at 0.12 microns, and the second container 30 is a 200-liter container containing water for injection (WFI) filtered at 0.2 microns. The substances are filtered prior to being placed in the containers, which can also be pre-sterilized. Moreover, the apparatus 10 is made to be transported or shipped to customers or end users. Preferably, the apparatus 10 is disposed after it is empty, except for the pump 42, which can remain on-site. Prior to shipping, the apparatus 10 is assembled by filling the first and second containers 20, 30 with their respective substances. The main tube T1, which includes tube sections 1-7, and the valves V1-V4 are connected, and all the valves are closed. The feeding tube T2 includes a sheath around it and/or can be placed in a bag with a twist tie. The entire assembled apparatus 10 (except the pump 42) is put in a first bag which is heat sealed or twist-tied. The apparatus 10 is then preferably placed in a second bag which is twist-tied. The bags are plastic. Due to the weight of the filled assembly 10, a lift is used to manipulate the container 30 and allow the bags to be placed around the assembly 10.

Alternatively, to avoid the cumbersome maneuver of the filled containers, the first and second containers can be placed in the bags before they are being filled with the substances. After the containers have been filled, the bags are then closed and sealed to form a container enclosure. The container enclosure is then put on a pallet (2 per pallet) and sterilized. Preferably, it is terminally sterilized by being transported to an irradiator for gamma irradiation.

Figure 4:
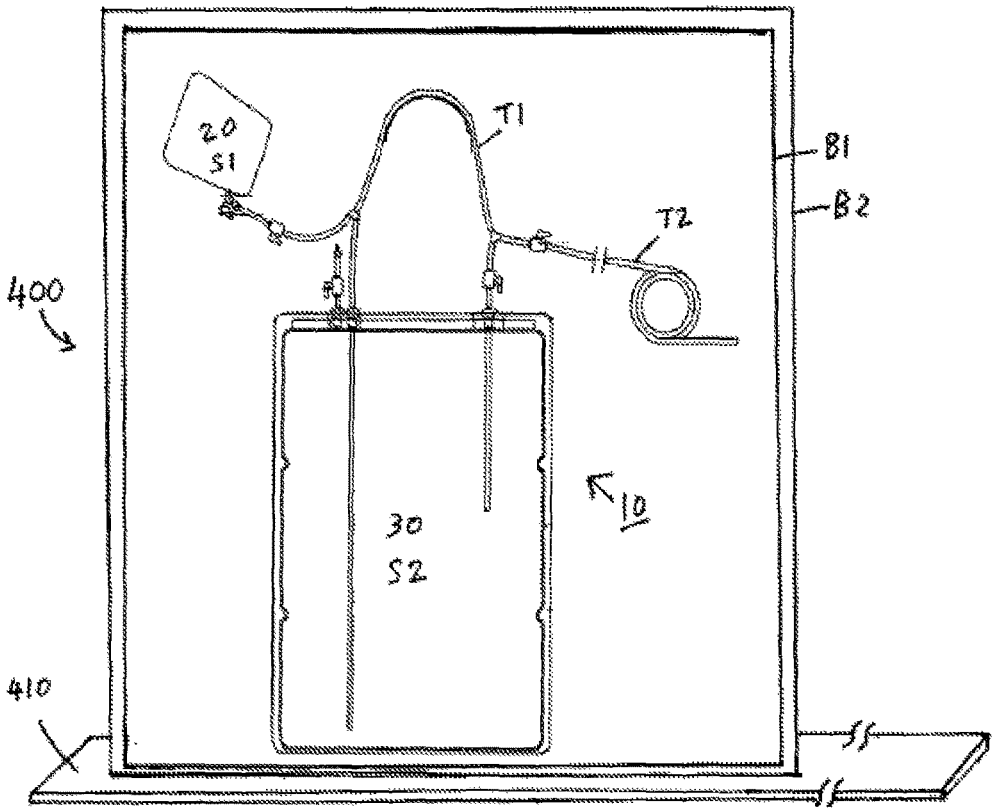
FIG. 4 is a container enclosure of the mixing and dispensing apparatus on a pallet according to another exemplary embodiment of the present invention.

FIG. 4 illustrates a container enclosure 400 on a pallet 410 according to an exemplary embodiment of the present invention. As shown in FIG. 4, the container enclosure 400 includes the apparatus 10 enclosed in a first bag B1 and a second bag B2. The apparatus 10 includes the first container 20 having a first substance S1, the second container 30 having a second substance S2, the main tube T1, and the feeding tube T2. The apparatus 10 is fully assembled by having the main tube T1 attached to the first and second containers 20, 30 and the feeding tube T2. The apparatus 10 is placed inside the first bag B1, which is then heat sealed or twist tied. The first bag B1 is placed inside the second bag B2, which is twist tied. The container enclosure 400 is placed on the pallet 410 and sterilized with gamma irradiation. As stated above, the containers 20, 30 are filled with the substances S1, S2 either before or after being placed in the bags B1, B2.

After the sterilizing process, the container enclosure 400 is sent to the end user, with or without the pallet 410. The pallet 410 can optionally be a closed container, that is also terminally sterilized. Instructions for assembling and operating the sterilized apparatus 10 may be provided with the shipment. The valves V1-V5 and tubes T1 and T2 are labeled to aid the end users in operating the apparatus 10.

Accordingly, the containers 20, 30 and the tubes T1, T2 form a closed system that is sterilized within the bags B1, B2. When the bags are opened for use, the containers 20, 30 and tubes remain closed. Thus, the substances and the internal portions of the containers 20, 30, and tubes remain sterile. The end user, therefore, need not perform any processing of the substances in the clean room.

The apparatus 10 is preferably placed in a clean room with rating of ISO 8/class 100,000/Grade C. In this room, the first bag layer can be removed. Subsequently, the apparatus 10 is placed in a cleaner room with an ISO 7/class 10,000/Grade B, which may be about eight feet away from the area that receives the dispensed disinfectant. In that room, the second bag layer is removed. Since the apparatus 10 is fully assembled prior to being bagged, the user only needs to place the middle tube section 4 around the pump 42, and the unit is ready to be used. The feeding tube T2 is fed into an ISO 5/class 100/Grade A clean room, such as through a hole in the wall or a controlled passage. Any bag or sheath around the feeding tube T2 can be removed inside the ISO 5 clean room. The tube T2 can then be used to dispense the mixed substances within the ISO 5 clean room, such as being placed into smaller pre-sterilized containers. The containers 20, 30 and tubes T1, T2 remain a closed system throughout use by the end user. Therefore, the substances remain sterile throughout the use of the system 10. The pump 42 can also be controlled to maintain a pressure at the dispensing tube T2 so that the system 10 is non-aspirating such that air or debris is not able to enter through the end of the tube T2 which might otherwise render the substances non-sterile. In addition, to assure the sterile integrity of the system, the end of the dispensing tube T2 may be installed with a valve to prevent the tube T2 from being contaminated. The valve is wrapped or sealed with heat seal inside a plastic bag.

The containers 20, 30 and tubes T1, T2 can be individually disposed after the containers 20, 30 have been fully emptied. The first container 20 can be easily disposed by detaching it at the neck 24. Though the assembly 10 is preferably terminally sterilized, it can be sterilized in any suitable manner, such as by being aseptically filled and processed within a clean room. Thus, irradiation need not be used in the sterilization process. Instead, each container, bag and valve can be pre-sterilized and aseptically assembled in a Class 100 area.

To set up the apparatus 10, after the double plastic bags are removed, the main tube T1 is placed in the pump slot (not shown) of the pump 42. A clamp (not shown) of the pump slot is then closed. The power cord of the pump 42 is connected to an outlet, such as a 115V socket. The feeding tube T2 is extended to the desired location.

Generally, the apparatus 10 has four modes of operation: 1) standby; 2) combining; 3) mixing; and 4) dispensing. In the standby mode, all of the five valves V1-V5 are closed. The first and second substances already exist in the first and second containers 20, 30, respectively.

In the combining mode, the second substances are combined in the second container 30. Here, the valves V1, V2 and V4 are opened while valves V3 and V5 remain closed. The pump 42 is then turned on, which pumps the first substance from the first container 20 into the second container 30 via the input pipe 36. The first container 20 can take between 1 to 1.5 minutes to empty. The first and second containers 20, 30 have predetermined amounts of liquid, so that the entire amount of liquid in the first container 20 can be emptied into the second container 30. After all of the first substance in the first container 20 has been drained into the second container 30, the pump 42 is then turned off.

Subsequently, the valves V1 and V2 are closed and the valves V4 and V5 are open. It is noted that the third valve V3 is still closed at this time. Accordingly, in the mixing mode, V1, V2, V3 are closed and V4, V5 are open. A circulating loop, including the output pipe 38, the third tube section 3 of the tube T1, the fourth tube section 4, the pump 42, the fifth tube section 5, the seventh tube section 7, and the input pipe 36, is created. The pump 42 is turned on to run for a certain period of time, such as 15 minutes. During this time period, the pump 42 circulates the mixture of the first and second substances in the second container 30 through the circulating loop. The pump 42 draws the mixture out from the bottom of the second container 30 through the output pipe 38 and the output neck 48. The mixture passes through the fourth tube section 4 of the main tube T1 and back into the second container 30 through the valve V4 and the input pipe 36. Such an operation allows the first substance to be thoroughly mixed with the second substance in the second container 30. After the mixing time period, the pump 42 is then turned off.

In the dispensing mode, the mixed substances are dispensed out from the feeding tube T2. Here, the valve V4 is closed and the valve V3 opened. As such, V1, V2, and V4 are closed while V3 and V5 are open. The pump 42 is turned on again to draw the mixed substance from inside the second container 30, and pump it through the output pipe 38, the main tube T1, the pump 42, the valve V3, and the feeding tube T2 to the desired location. A user may dispense the mixed substance as much as desired by activating and deactivating the pump 42. As mentioned above, the feeding tube T2 may also have a valve (not shown) at the desired location such that the user can open the valve to dispense the mixed substance.

The apparatus 10 can be operated manually or electronically. Manually, the valves V1-V5 are easy to be opened and closed with a gloved hand in a clean room. The pump 42 can be turned on and off manually with a switch, or the pump 42 can be an on-demand pump so it only turns on when the valve V3 is opened. In the automatic or electronic mode, a control panel is provided at the desired location to remotely control the pump 42. The control panel may wirelessly communicate with the pump 42. Another control panel may be provided at the pump station 44. Each control panel may include buttons or switches for various modes of operation such as power on-off, standby, combining, mixing, and dispensing the substances. These automatic modes of operation will turn on the pump 42 and operate the valves V1-V5 accordingly.

Figure 3:
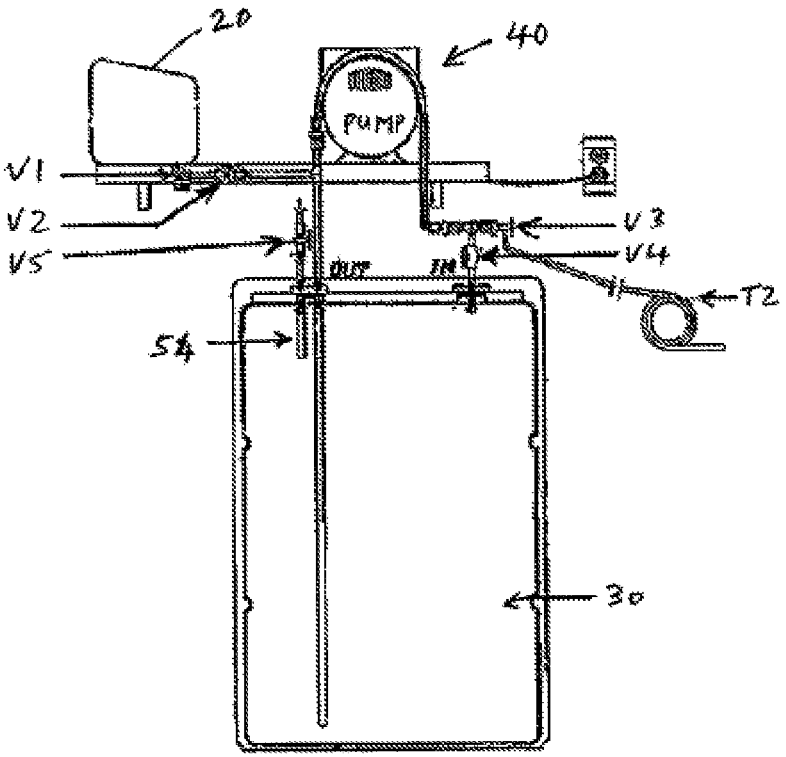
FIG. 3 is a mixing and dispensing apparatus with hard pipes according to another exemplary embodiment of the present invention.

FIG. 3 shows a mixing and dispensing apparatus according to another exemplary embodiment of the invention. This embodiment is similar to the embodiment in FIG. 1 except the tubes T1 and T2 are hard pipes, preferably copper, and the valves are those used for hard pipes. In FIG. 3, the second container 30 does not have the input pipe 36 as in the container of FIG. 1. Furthermore, FIG. 3 includes a tube 54 connected to the output neck 48 inside the second container 30. The tube 54 preferably contains a filter for preventing dirt from outside getting inside the second container 30.

While preferred embodiments of the invention have been set forth above, those skilled in the art will readily appreciate that other embodiments can be realized within the scope of the invention. For example, the bags placed around the second container 30 can be polyethylene. The second container 30 can be placed in one bag instead of two. Moreover, rather than filling the second container 30 with the second substance before lifting the filled container into a bag, the empty second container 30 can be placed in the bag first, then filled with the second substance, and the bag is then sealed closed. In addition, while the invention has been described and shown with two containers and two substances that are combined and mixed on-site, it also has uses for a single container having a single substance. The single container and substance can be sterilized with the dispensing tube T2 connected so that the tube T2 need only be connected to the pump for use by the end user. The present invention, therefore, should be construed as limited only by the appended claims.

We claim:

1. A mixing and dispensing apparatus, comprising:

a first container for containing a first substance;

a second container for containing a second substance;

a tube system configured to combine the first and second substances into one combined substance, mix the combined substance, and dispense the combined substance; and a fluid-impermeable enclosure enclosing the first container, the second container, and the tube system, wherein the mixing and dispensing apparatus is a closed system whereby the tube system combines only contents of the first container and the second container.

2. The apparatus of claim 1, wherein the first container, the second container, and the tube system are enclosed in the fluid-impermeable enclosure without a pump.

3. The apparatus of claim 1, wherein the tube system is configured to receive a peristaltic pump to combine the first and second substances.

4. The apparatus of claim 1, wherein the second container includes an exhaust pipe that allows air to be drawn into the second container.

5. The apparatus of claim 1, wherein the second container comprises a top comprising:

an input neck sealed by a sealing device;

an output neck sealed by a sealing device;

an input pipe disposed inside the second container and attached to the sealing device at the input neck; and an output pipe disposed inside the second container and attached to the sealing device at the output neck.

6. The apparatus of claim 5, further comprising a feeding tube, connected to the tube system, configured to receive the combined substance, wherein:

the tube system comprises:

a main tube;

a first valve connected between the first container and one end of the main tube;

a second valve connected between the main tube and the feeding tube; and a third valve connected between the main tube and the input neck, and the main tube comprises:

a first tube section connecting the first valve and a first Y-connector;

a second tube section connecting the output neck and the first Y-connector;

a third tube section connecting the first Y-connector to a second Y-connector;

a fourth tube section connecting the second Y-connector to the third valve;

a fifth tube section connecting the second Y-connector to the second valve; and a sixth tube section connecting the third valve to the input neck.

7. The apparatus of claim 6, wherein:

the third tube section is configured to receive a pump configured to pump the first and second substances; and the third tube section is configured to provide a fluid impermeable path from the first Y-connector to the second Y-connector regardless of whether the pump is connected.

8. The apparatus of claim 6, wherein:

during a combining of the first substance and the second substance, the first and third valves are configured to be opened and the second valve is configured to be closed;

during a mixing of the combined substance, the first and second valves are configured to be closed and the third valve is configured to be opened; and during a dispensing of the combined substance, the first and third valves are configured to be closed and the second valve is configured to be opened.

9. The apparatus of claim 6, wherein the main tube and the feeding tube are flexible.

10. The apparatus of claim 6, wherein the main tube and the feeding tube are hard pipes.

11. A method, comprising:

filling a first container with a first substance;

filling a second container with a second substance;

providing a tube system configured to combine the first and second substances into a combined substance, mix the combined substance, and dispense the combined substance, wherein the tube system combines only contents of the first container and the second container; and enclosing the first container, the second container, and the tube system in a fluid-impermeable enclosure.

12. The method of claim 11, wherein the first container, the second container, and the tube system are enclosed in the fluid-impermeable enclosure without a pump.

13. The method of claim 11, further comprising:

providing a peristaltic pump;

combining the first and second substances into a combined substance;

mixing the combined substance; and dispensing the combined substance.

14. The method of claim 11, wherein the second container includes an exhaust pipe that allows air to be drawn into the second container.

15. The method of claim 11, wherein the second container comprises:

an input neck sealed by a sealing device;

an output neck sealed by a sealing device;

an input pipe disposed inside the second container and attached to the sealing device at the input neck; and an output pipe disposed inside the second container and attached to the sealing device at the output neck.

16. The method of claim 15, further comprising:

providing a feeding tube, connected to the tube system, configured to receive the combined substance, wherein:

the tube system comprises:

a main tube;

a first valve connected between the first container and one end of the main tube;

a second valve connected between the main tube and the feeding tube; and a third valve connected between the main tube and the input neck; and the main tube comprises:

a first tube section connecting the first valve and a first Y-connector;

a second tube section connecting the output neck and the first Y-connector;

a third tube section connecting the first Y-connector to a second Y-connector;

a fourth tube section connecting the second Y-connector to the third valve;

a fifth tube section connecting the second Y-connector to the second valve; and a sixth tube section connecting the third valve to the input neck.

17. The method of claim 16, further comprising:

removably connecting a pump to the third tube section;

combining the first and second substances into a combined substance;

mixing the combined substance; and dispensing the combined substance, wherein the third tube section is configured to provide a fluid impermeable path from the first Y-connector to the second Y-connector regardless of whether the pump is connected.

18. The method of claim 16, further comprising:

combining the first substance and the second substance into a combined substance by opening the first and third valves and closing the second valve;

mixing the combined substance by closing the first and second valves and opening the third valve; and dispensing the combined substance by closing the first and third valves and opening the second valve.

19. The method of claim 16, wherein the main tube and the feeding tube are flexible.

20. The method of claim 16, wherein the main tube and the feeding tube are hard pipes.

* * * * *